US008074575B2

(12) United States Patent
Aguirre Fernandez

(10) Patent No.: US 8,074,575 B2
(45) Date of Patent: Dec. 13, 2011

(54) MACHINE FOR POSITIONING AND ALIGNING OF RAILROAD TIES

(75) Inventor: Jose Ma Aguirre Fernandez, Madrid (ES)

(73) Assignee: Tecsa Empresa Constructora, S.A., Madrid (ES)

( * ) Notice: Subject to any disclaimer, the term of this patent is extended or adjusted under 35 U.S.C. 154(b) by 38 days.

(21) Appl. No.: 12/722,582

(22) Filed: Mar. 12, 2010

(65) Prior Publication Data

US 2010/0242780 A1 Sep. 30, 2010

(30) Foreign Application Priority Data

Mar. 27, 2009 (ES) ..... 200930013

(51) Int. Cl.
*E01B 29/00* (2006.01)

(52) U.S. Cl. ..... 104/2; 104/8; 104/7.2

(58) Field of Classification Search ..... 104/2, 3, 104/7.1, 7.2, 8, 9, 4
See application file for complete search history.

(56) References Cited

U.S. PATENT DOCUMENTS 2,736,268 A * 2/1956 Yohe ..... 104/8
3,260,218 A * 7/1966 Pyke ..... 104/9
3,451,349 A 6/1969 Yard
3,628,460 A * 12/1971 Von Beckmann ..... 104/8
4,125,075 A * 11/1978 Stewart ..... 104/7.2
4,867,068 A * 9/1989 Valditerra ..... 104/2
4,895,078 A * 1/1990 Mancini ..... 104/8
7,258,069 B1 * 8/2007 Cotsford ..... 104/7.1
7,380,506 B2 * 6/2008 Hammarstrand ..... 104/6
2007/0003402 A1 1/2007 Hammarstrand

FOREIGN PATENT DOCUMENTS

FR 2253874 A 7/1975
FR 2465030 A 3/1981
GB 2159560 A 12/1985
GB 2166474 A 5/1986
GB 2433955 A 7/2007

* cited by examiner

*Primary Examiner* — Mark Le
(74) *Attorney, Agent, or Firm* — Brown & Michaels, PC

(57) ABSTRACT

The invention relates to a machine for positioning and squaring crossties of railway tracks, formed by at least one wagon (1), provided with its own means for traveling over the rails (2) of the railway track under construction in which the crossties (3) have not yet been aligned, which laterally has respective metal profiles (4) arranged longitudinally at the level of the crossties (3) of the track, supported to the main structure of the wagon by means of angled arms (5), which on their inner face have a series of equidistant positioning wedges (7), which are in charge of coming into contact and positioning the crossties previously distributed in the layout, such that the wedges are located between them, pushing them laterally and longitudinally until leaving the crossties in the correct position: centered and perpendicular to he center line, aligned and separated from one another by a uniform distance.

5 Claims, 5 Drawing Sheets

MACHINE FOR POSITIONING AND ALIGNING OF RAILROAD TIES

REFERENCE TO RELATED APPLICATIONS

This application claims an invention which was disclosed in Spanish application number P200930013, filed Mar. 27, 2009, entitled "MACHINE FOR POSITIONING AND ALIGNING OF RAILROAD TIES". The aforementioned application is hereby incorporated herein by reference.

OBJECT OF THE INVENTION

The present invention relates to a machine for positioning and squaring crossties, which automatically and efficiently performs the activity for positioning and squaring the crossties of the track once the rail is placed.

The activity for squaring crossties within the railway track assembly consists of the following: Once the rail is laid on the crossties previously distributed in a regular manner along the ballast bed, and before performing the definitive tightening of the fasteners which fix the rail to the crossties, it is necessary to leave the crossties in their correct position, equidistant from one another by a distance of 60 cm and also to position them perpendicular to the track center line and centered thereon, all of this within the tolerances required by current regulations.

BACKGROUND OF THE INVENTION

This process is currently performed manually by several operators provided with metal bars which they use as a lever, pulling and shifting the crosstie until its correct definitive position. They also manually check with a square the perpendicularity of each of the crossties with respect to the rails and its correct distance to the previous crosstie.

This process performed in this manner is extremely slow and imprecise. In addition, given the large weight of the crossties, it is a physical risk for the operators, and causes a large number of injuries throughout the year.

DESCRIPTION OF THE INVENTION

The objective of this invention is a machine which allows solving the problems set forth: a machine for positioning-squaring crossties. This machine is capable of automatically positioning and squaring the crossties of a track with precision, leaving them within the required tolerances once the rail is laid and positioned thereon.

The machine is initially formed by two wagons, a driving wagon and another driven wagon, each of which has the capacity to place the crossties of the track with precision. The driving wagon can work independently and form by itself the machine for positioning and squaring crossties.

The driving wagon consists of a chassis with a metal structure provided at the lower part with four railway wheels which allow it to travel over the rails of a railway track. Laterally, it has metal profiles arranged longitudinally, which are located in a lower level, at the height of the crossties of the track, supported to the main structure by means of two metal arms with an angular shape provided with hydraulic cylinders. On the inner face of these two lateral profiles, which comes into contact with the crossties, and along the entire length thereof, they have a series of positioning wedges fixed in an equidistant manner with strict tolerances, which are in charge of coming into contact and properly positioning the crossties.

In the work position, when the hydraulic system is actuated, the metal arms of both sides rotate about shafts fixed in the chassis, moving both profiles closer to one another, closing them in the plane of the track on the crossties previously distributed in the layout, performing a movement similar to that of pincers. The positioning wedges are fixed to the longitudinal lateral profiles in an equidistant manner and leaving therebetween the exact space of a head of crosstie, such that upon closing the longitudinal profiles of both sides of the track on the crossties and pressing them on both sides, the wedges are located between the crossties, separating them to the required measurement, moving them as a result of the pressure transmitted by the cylinders through the arms to the longitudinal profiles and to the wedges, until placing all the crossties in their exact position. To that end, the geometry of the wedges is designed such that their surfaces come into contact with smooth faces of the head of the crosstie, not with edges in order to prevent damaging them. The wedges are placed such that once both longitudinal profiles are completely closed on the crossties, the latter are perfectly positioned and squared, with the tolerances of distance between the axes thereof, perpendicularity with respect to the track center line and centered on said center line defined in the regulations.

The machine also has a system for fixing to the rails to prevent any travel. This system acts once the machine is stopped in the work position and consists of hydraulically actuated clamps fixing the machine to the rails. The chassis has four closing clamps—two front closing clamps—one for each rail—and two rear closing clamps. The clamps press the rail in the core thereof or in the lower part, not on the head, because otherwise the running surface of the rail could be damaged.

In the work position, in which the actuations of the hydraulic system necessary for positioning the crossties are performed, the machine must be in a rest position without any travel, for which it is fixed to the rails as a result of the clamps also actuated by the hydraulic system. Once the crossties corresponding to the length of the longitudinal metal profiles are positioned, the machine must open the two lateral assemblies of arms and longitudinal profiles, lifting them as a result of the rotation of the arms on their shafts, and thus releasing the already positioned crossties. At this moment the fixing clamps for the fixing to the rail are released. In the open position of both assemblies, the machine can advance towards the area of non-positioned crossties. The advance, which occurs as a result of motors installed for that purpose, takes place until the point at which the last rear wedge is located close to the last already aligned crosstie, such that the entire length of the profiles encompasses crossties that are not yet aligned, taking the last aligned crosstie as a reference.

The machine has an electronic control system and a position sensor, fixedly placed in the machine and in an exact and calibrated position. Once the advance of the machine starts, the sensor, of laser type or another type, identifies each crosstie over which it passes. The entire system is controlled by a PLC, which collects the information taken by the sensor and counts the number of crossties over which the sensor passes. When the number of crossties coincides in the exact advance length thereof with the distance between the end wedges of the longitudinal profile, the PLC sends the signal for stopping the advance of the machine. The stopping can be performed by stages, such that before some crossties reach the stop point, the advance speed is reduced to a much lower speed, which is referred to as approaching speed. The stopping of the machine at the required point with maximum accuracy is thus achieved.

Once the machine is stopped, the work phase is started again, the fixing clamps being closed and the assemblies of longitudinal metal profiles-wedges of both sides being closed on the crosstie, thus positioning the following assembly of crossties. The work cycle is thus completed, which cycle is started again successively.

The machine is formed by at least one driving wagon in which the control post, the heat engine, the tank and the central unit of the hydraulic system, pump, and the electronic assembly controlling the movements for positioning crossties are located, as well as the control post, preferably protected by a cabin. The controls are located in the panel of the control console. The "dead man's" safety pedal is also located optionally in this control post. Additionally, the perimeter of the wagon is protected by a railing and the floor is covered with a framework to allow people to move thereon.

When the machine is formed by several wagons, it will have at least one driving wagon and several driven wagons, which have the same features, structure and description as the driving wagon, except that they do not have their own control or driving system. They are coupled and driven by the driving wagon. The physical attachment between wagons is performed by means of a ball joint system. The hydraulic system has quick couplings for connecting the circuit of the driven wagon to the driving wagon.

The machine of the invention involves a considerable improvement in the track assembly process, since it performs the task for positioning and squaring crossties automatically, positioning multiple crossties simultaneously and in a matter of seconds, therefore much higher efficiencies are achieved. Furthermore, the placement is much more precise, eliminating the possible human error and it eliminates the occupational hazards and fatigue risks of the manual process.

DESCRIPTION OF THE DRAWINGS

To complement the description which is being made and for the purpose of facilitating the understanding of the features of the invention, a set of drawings is attached to this specification in which the following has been depicted with an illustrative and non-limiting character.

PREFERRED EMBODIMENT OF THE INVENTION

Figure 1:
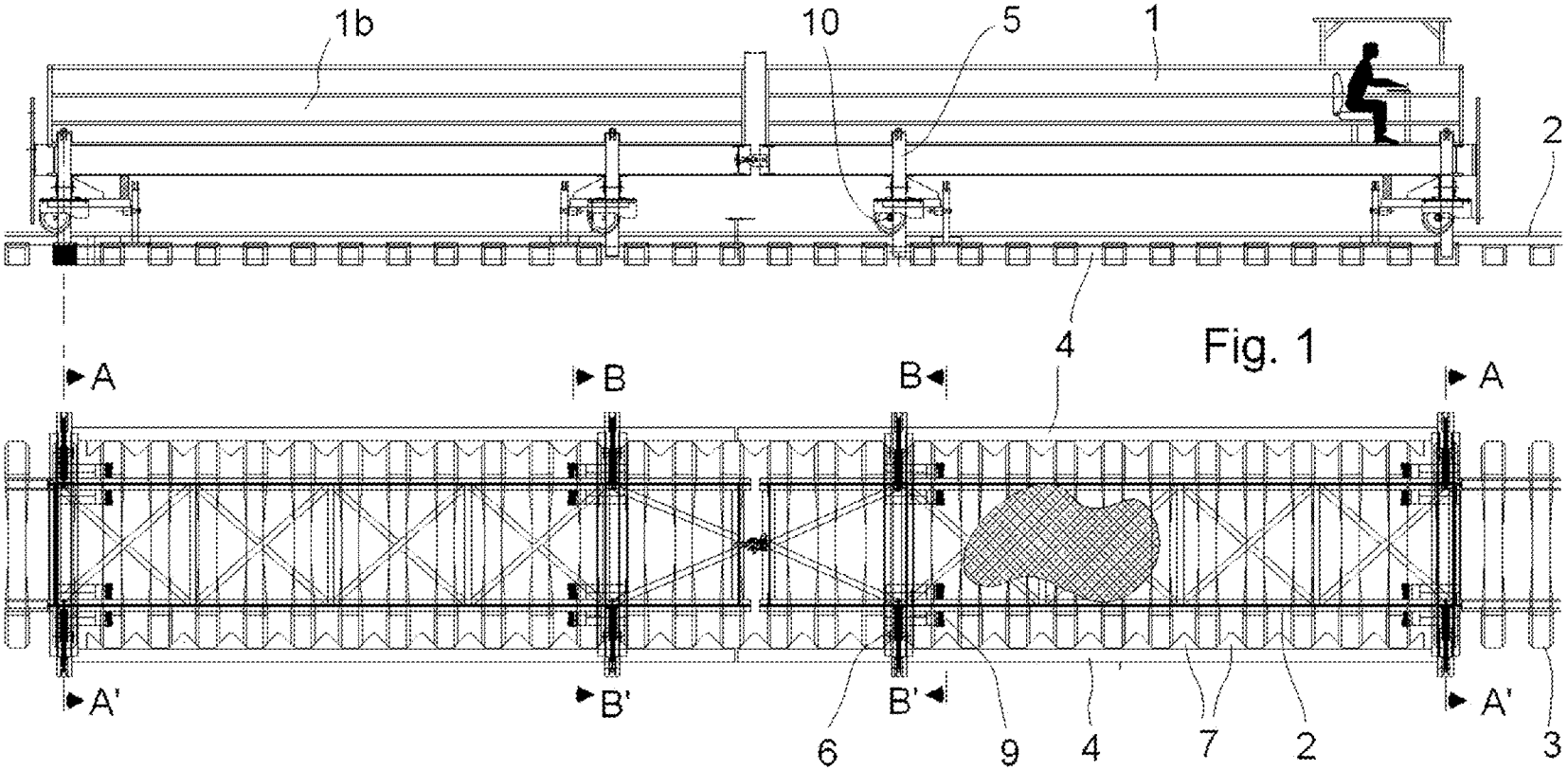
FIG. 1 shows a plan view of a machine for positioning crossties of a railway track, formed in this case by two wagons: a driving wagon (1) and another driven wagon (1*b*).

As can be observed in the indicated figures, the machine for positioning and squaring crossties of railway tracks of the invention is formed by at least one wagon (1), which travels over the rails (2) of the railway track under construction supported in at least two axles of wheels (10), the crossties (3) being not yet aligned and logically with the rails (2) only deposited thereon and without fixing. Optionally, as seen in FIG. 1, this machine is formed by several wagons, one of which is a driving wagon and has the motors for traveling over the track, as well as the machine control systems, the place of location of the operator, the electronic control of travel and of the movements for positioning the crossties and the other elements necessary for working by itself, whereas the remaining wagons (1*b*) are driven by the driving wagon (1) and have a structure and positioning and squaring mechanisms like those of said driving wagon.

The positioning and squaring mechanisms existing in each wagon (1), regardless of whether it is a driving or driven wagon, are formed by respective lateral profiles (4), arranged longitudinally at the level of the crossties (3) of the track and are supported in the main structure of the wagon by means of L-shaped arms (5), which are articulated in the angle (8) and are actuated by respective hydraulic cylinders (6). On the inner face said profiles (4) are provided with a series of equidistant wedges (7) which are in charge of coming into contact and positioning the crossties (3) when they start operating.

Figure 2:
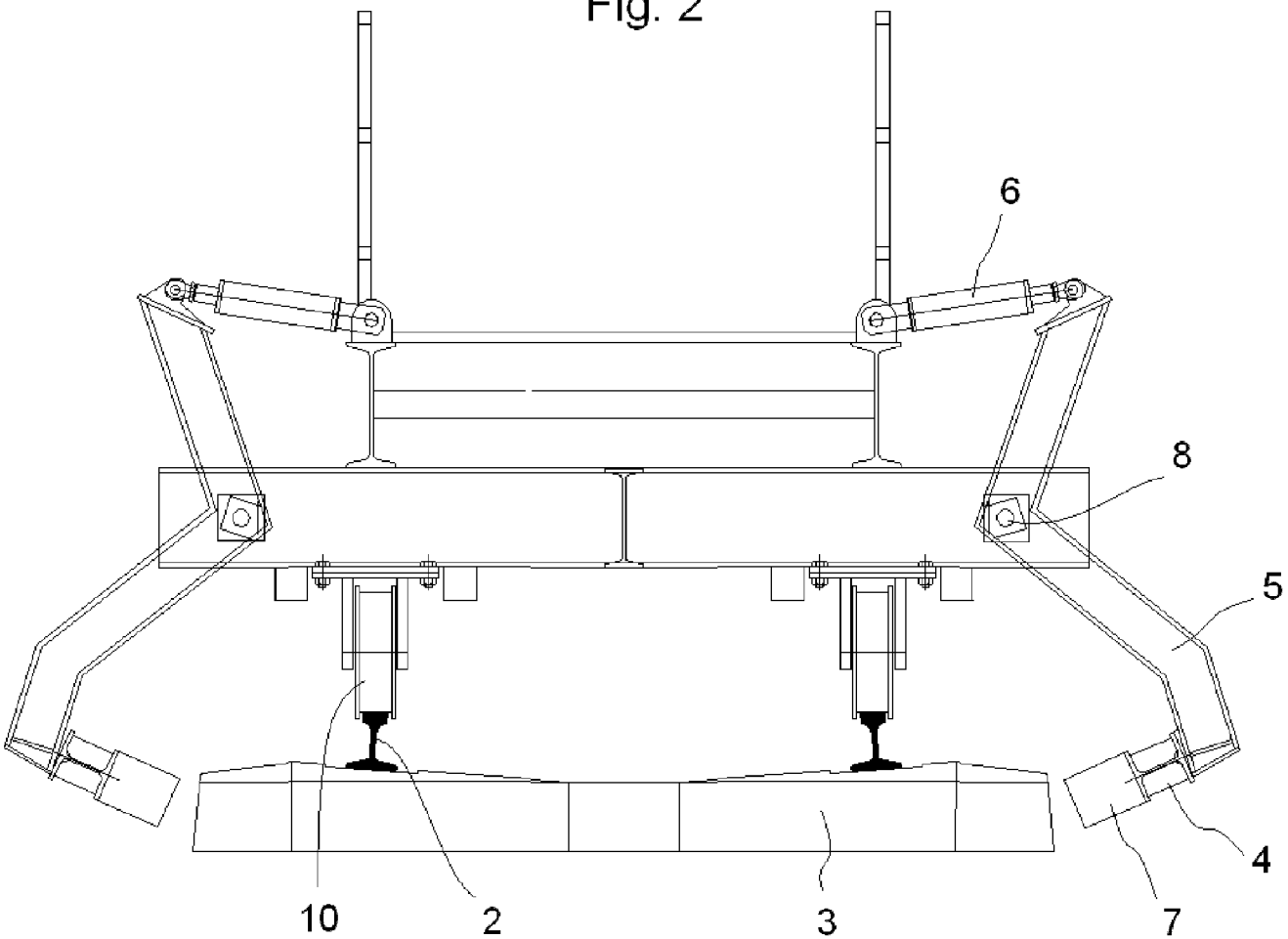
FIG. 2 depicts any of the sections marked as A-A' in FIG. 1, according to the axle of the wheels (10) of the wagon, when the machine is in the advance position.
Figure 3:
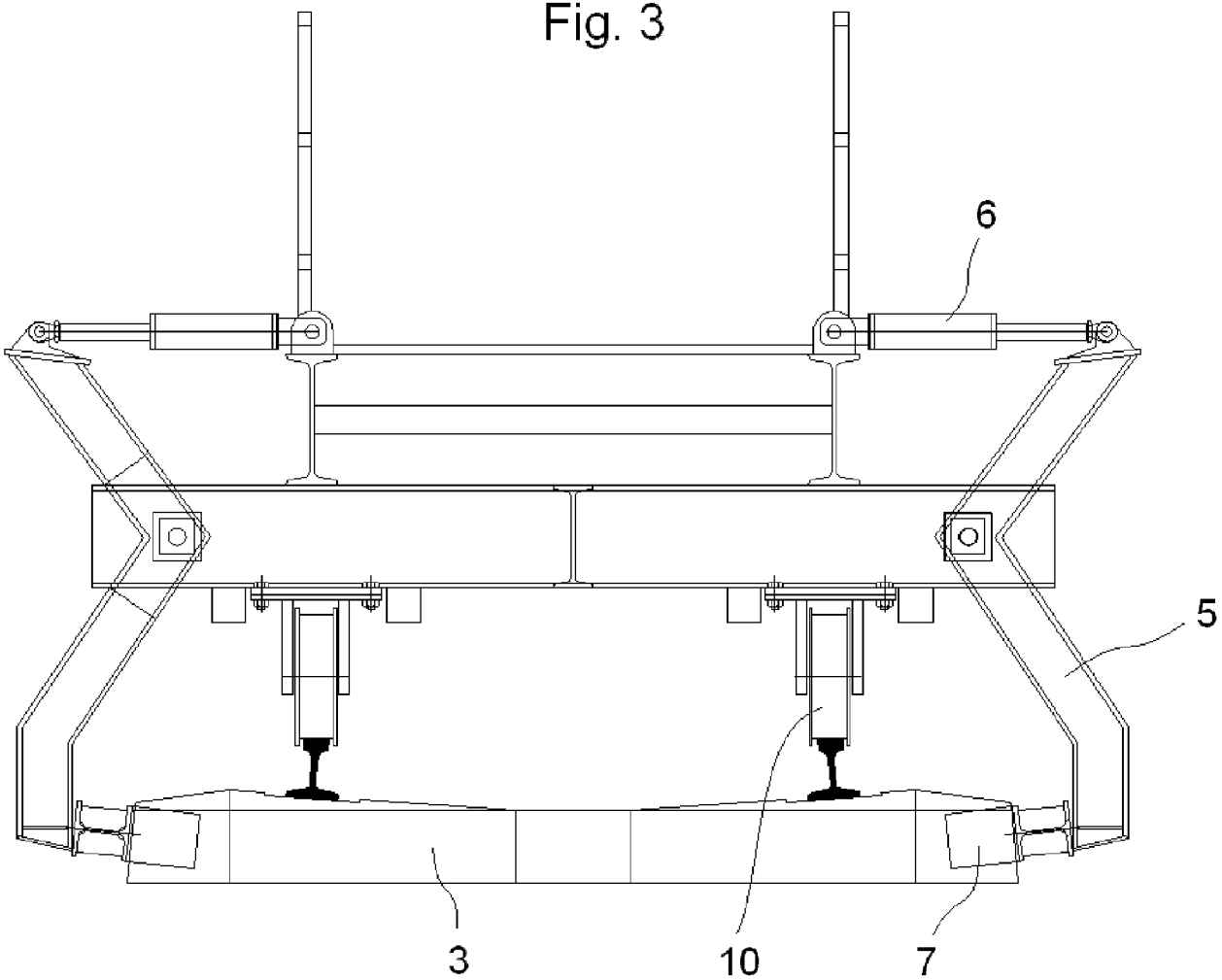
FIG. 3 depicts any of the sections marked as A-A' in FIG. 1, when the machine is in the work position.
Figure 4:
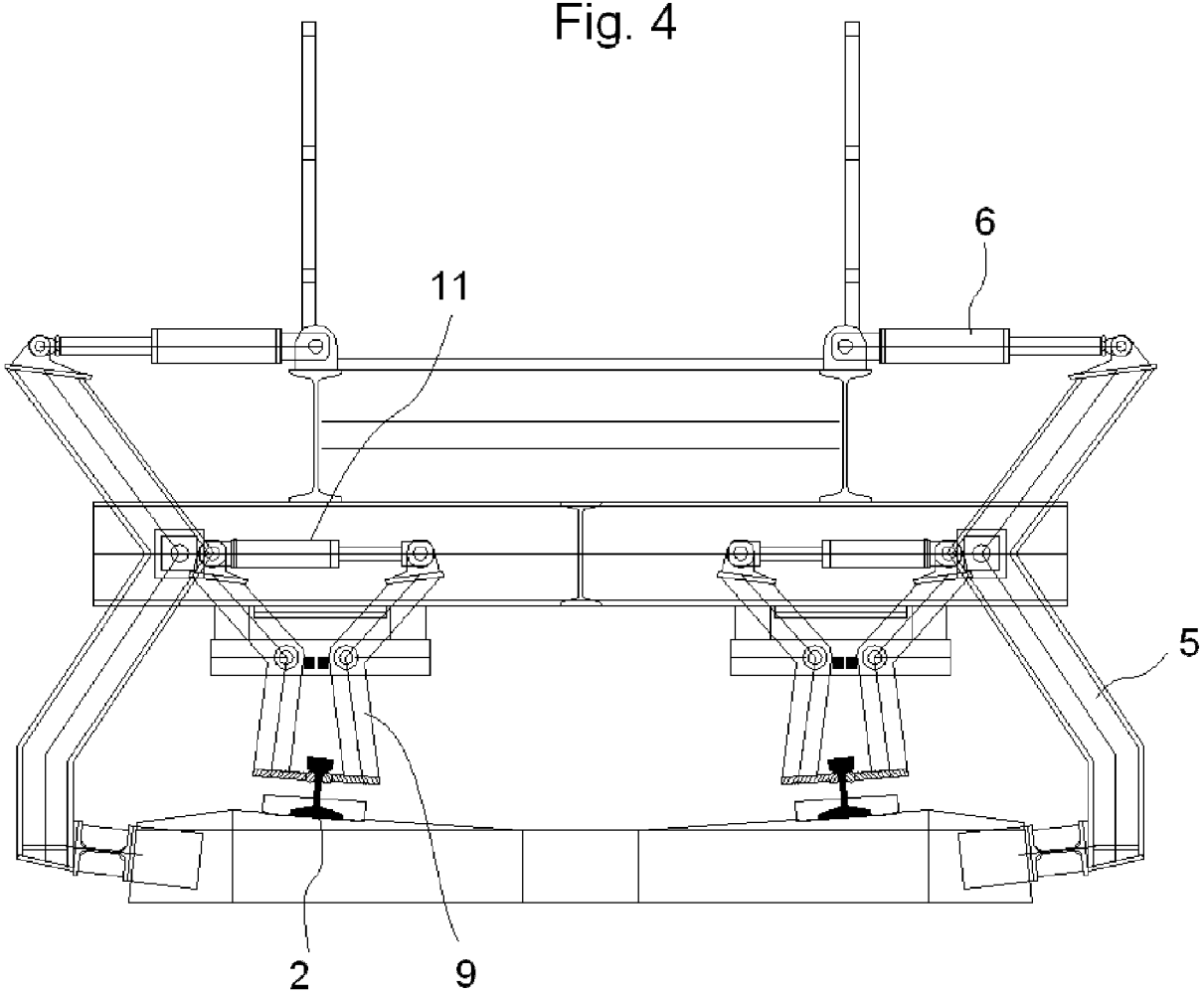
FIG. 4 depicts any of the sections marked as B-B' in FIG. 1, according to the plane of the clamps (9), when the machine is in the work position.
Figure 5:
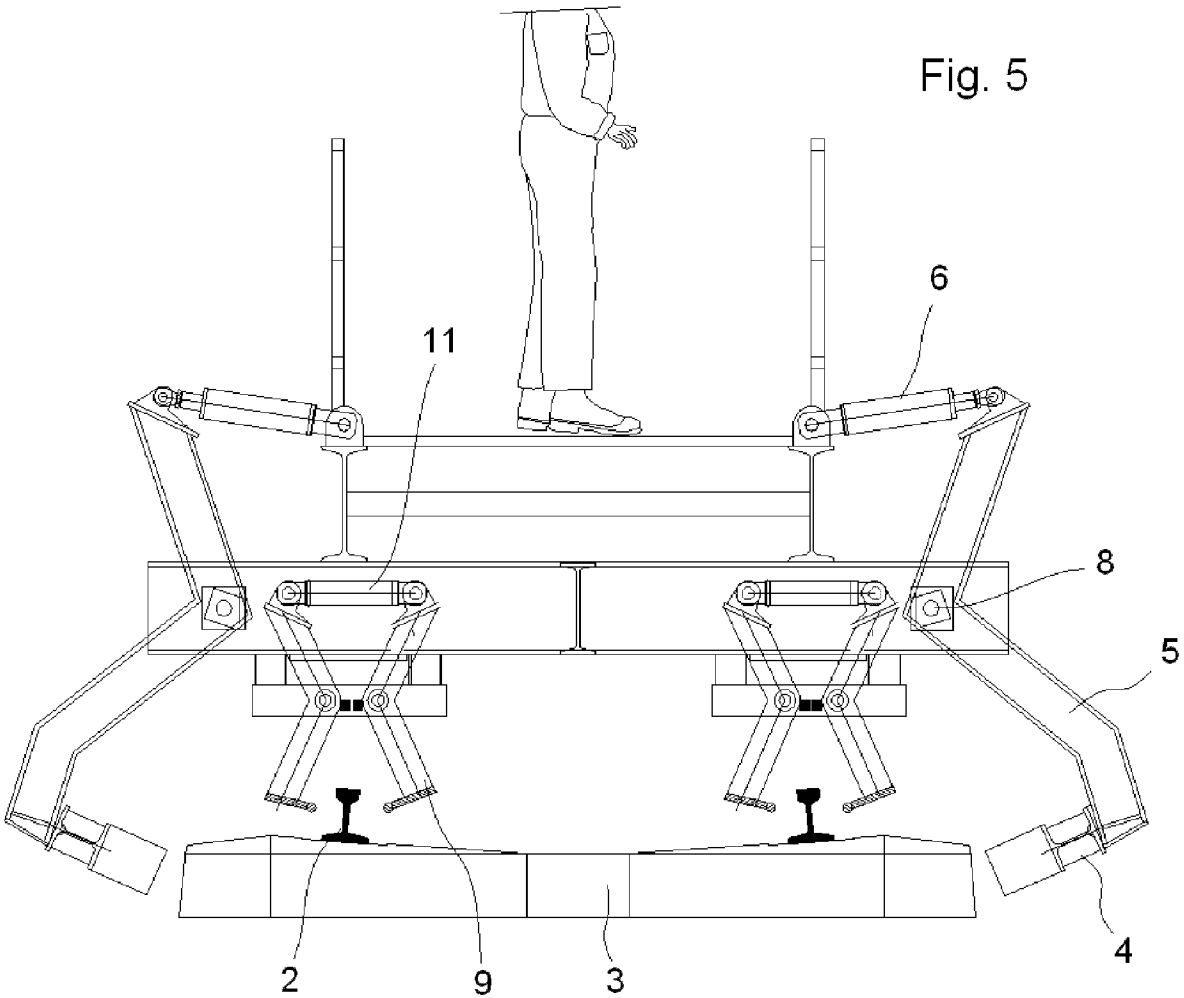
FIG. 5 depicts any of the sections marked as B-B' in FIG. 1, when the machine is in the advance position.

In the advance position of the machine, as depicted in FIGS. 2 and 5, said profiles adopt a lifted position and are consequently separated from the heads of the crossties (3) which must form the track. In the work position, see FIGS. 3 and 4, said profiles are actuated by means of the hydraulic cylinders (6), which drive the arms (5) of both sides, rotating about their corresponding shaft (8) located in the chassis of the wagon (1), moving them closer to one another, closing them in the plane of the track on the crossties (3) previously distributed in the layout, such that the wedges are located between them, pushing them laterally and longitudinally until leaving the crossties in the correct position: centered and perpendicular to the center line, aligned and separated from one another by a uniform distance.

The wedges (7) have been designed such that the V-shaped surfaces coming into contact with the smooth faces of the heads of the crossties (3) are free of edges so that they do not damage such crossties during their action. The successive wedges, which are located in the respective longitudinal profiles (4), are placed facing one another therealong, such that when these profiles move close to one another, such profiles being completely closed on the crossties, the wedges are perfectly positioned and squared, with the tolerances of distance between the axes thereof, perpendicularity with respect to the track center line and centered on said center line, to achieve that the crossties are in the same position.

As seen in FIGS. 4 and 5, at the lower part the wagon (1) has a device for fixing to the rails (2) of the track under construction to prevent the lateral shifting thereof, consisting of at least one pair of clamps (9), which are actuated by means of a hydraulic cylinder (11) so that they press the rails (2) in the core thereof or in the lower part, while the machine is stopped in the work position (see FIG. 4). These clamps are opened when the machine is going to start the travel as shown in FIG. 5.

The machine has an electronic control device and a position sensor, not depicted in the figures, which are located in an exact and calibrated position. This sensor allows identifying the crossties over which it passes, so that the electronic control counts the number of crossties, until advancing an exact length, then sending an advance stopping signal to the motor of the machine, the last wedge (7) being located close to the last already aligned crosstie, such that the entire length of the profiles encompasses crossties that are not yet aligned.

Having sufficiently described the nature of the invention, as well as a preferred embodiment, it is stated for the relevant purposes that the materials, shape, size and arrangement of the described elements may be modified, provide that this does not entail an alteration of the essential features of the invention which are claimed below:

The invention claimed is:

1. A machine for positioning and squaring crossties of a railway track comprising:

at least one wagon (1) comprising a chassis having at least two assemblies spaced along the chassis,the at least two assemblies comprising:

a pair of wheels (10) supported by the chassis for traveling over rails (2) of a railway track under construction in which the crossties (3) have not yet been aligned, a main structure having an upper portion and a lower portion; and at least one pair of angled arms (5), arranged longitudinally, each angled arm having a first end actuated by a hydraulic cylinder (6) coupled to an upper portion of the main structure, a second end below the lower portion of the main structure, the angled arms being pivotally connected (8) to the main structure by a pivot at a point between the first end and the second end;

a longitudinal profile (4) extending along at least a portion of a length of the wagon at a level of the crossties, coupled to the second end of each angled arm, comprising a plurality of wedges (7) spaced for pushing crossties (3) into position to be secured;

wherein when the at least one wagon (1) is in an advance position, the at least one pair of angled arms (5) are raised to a position in which the wedges (7) of the longitudinal profiles (4) are disengaged from the crossties (3);

wherein when the at least one wagon (1) is in a work position, the at least one pair of angled arms (5) are actuated by the hydraulic cylinders (6) to rotate about pivot, moving the longitudinal profiles at the second ends of the at least one pair of angled arms (5) closer to each other, closing the longitudinal profiles (4) in a plane of the railroad track under construction, such that the plurality of wedges (7) of the longitudinal profiles (4) push the crossties (3) laterally and longitudinally into a position in which a plurality of crossties (3) are centered along a centerline, perpendicular to the centerline and separated by a uniform distance.

2. The machine of claim 1, further comprising a device for fixing the at least one wagon (1) to the rails (2) of the railroad track under construction to prevent shifting of the at least one wagon (1), the device comprising at least one pair of clamps (9) extending below the lower portion of the main structure and actuated by a hydraulic cylinder (11) coupled to the main structure, such that when the clamps (9) are actuated, the clamps (9) press the rails (2) of the railroad track under construction in a middle or in a lower part of the rails (2).

3. The machine of claim 1, further comprising a position sensor on the machine in a calibrated position, wherein said sensor identifies each crosstie over which it has passed, and counts the number of crossties over which it passes, such that the machine advances a predefined length along the track.

4. The machine of claim 1, wherein the wedges (7) have V-shaped surfaces for contacting faces of the crossties (3), facing one another therealong, such that when the longitudinal profiles (4) of the least one pair of arms (5) are completely closed on the crossties (3), the wedges square and align the plurality of crossties perpendicularity with respect to the track center line and centered on the center line.

5. The machine of claim 1, further comprising at least a second wagon (1*b*), wherein one of the wagons is a driving wagon and comprises a control post for an operator and electronic control of travel and movements for positioning the crossties.

* * * * *